US006257262B1

(12) United States Patent
Anitole

(10) Patent No.: US 6,257,262 B1
(45) Date of Patent: Jul. 10, 2001

(54) BUILDING SHAPE MODIFICATION CAMOUFLAGE STRUCTURES

(75) Inventor: George Anitole, Arlington, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 585 days.

(21) Appl. No.: 08/876,762

(22) Filed: Jun. 16, 1997

Related U.S. Application Data

(63) Continuation-in-part of application No. 08/530,396, filed on Sep. 22, 1995, now abandoned.

(51) Int. Cl.[7] ..... E04H 15/44
(52) U.S. Cl. ..... 135/123; 135/901
(58) Field of Search ..... 52/64, 646; 135/95, 135/97, 121, 123, 143, 153, 157, 901, 903

(56) References Cited

U.S. PATENT DOCUMENTS 2,255,837 * 9/1941 Volk ..... 135/123 X
5,010,909 * 4/1991 Cleveland ..... 135/901
5,377,711 * 1/1995 Mueller ..... 135/901

FOREIGN PATENT DOCUMENTS

6708080 * 12/1968 (NL) ..... 135/97
91/19872 * 12/1991 (WO) ..... 135/123

* cited by examiner

*Primary Examiner*—Richard Chilcot
(74) *Attorney, Agent, or Firm*—Milton W. Lee; Alain L. Bashore

(57) ABSTRACT

There is provided herein a three-dimensional structure for camouflaging edifices having a large roof area from effective identification and targeting by aerial observation. The structure is light in weight, has minimal bulk, and is relatively easy to transport and deploy. The structure is comprised of a light weight metal frame having structural bar members arranged in substantially parallel horizontal and vertical arrays when assembled. The bar members are connected to each other by hinges so that the structure may be readily collapsed (lowered) or raised quickly and on short notice. The structure is deployable and retractable (i.e., may be raised or lowered) with the camouflage cover placed over the frame. A fabric cover imbued with camouflage patterns and colors on its exterior side is draped over the frame. Windup cables, pulleys and winches or cranks allow for the raising or lowering of the structure from the ground or other remote location. Servo systems may be employed for the winching operations, and in an alternative embodiment, the powered drive system may be connected directly to the metal frame.

7 Claims, 3 Drawing Sheets

BUILDING SHAPE MODIFICATION CAMOUFLAGE STRUCTURES

This is a continuation-in-part of application Ser. No. 08/530,396, filed on Sep. 22, 1995, now abandoned.

BACKGROUND OF THE INVENTION

Large roofed buildings present a unique challenge to the art of camouflage because most such edifices exist in urban environments wherein conventional camouflage that imitates the characteristics of natural vegetation is out of place and ineffective. Large roofed buildings are especially difficult to disguise from aerial reconnaissance and observation because of their size and shape: Their identification and location probably have been established through photographic means. Such buildings stand out against an urban background when viewed from the air and could serve as good central aiming points during an air attack.

This invention pertains to three-dimensional structures that provide building shape modification camouflage for edifices, especially those subject to aerial reconnaissance. More particularly, this invention pertains to quickly erectable and quickly modifiable three-dimensional structures that provide shape modification to break up and camouflage the expanse and form of large roofed buildings subject to aerial reconnaissance and observation. The structures of the invention may be raised or lowered repeatedly with the camouflage covering draped over the frame, eliminating the need for crews to visit the site of the camouflage structure to enable the structure to be raised (deployed) or lowered (retracted). The shape modification camouflage will cause such buildings to appear as smaller buildings resembling the smaller structural forms customarily found in the vicinity. It blends large roofs into busy building backgrounds which do not attract the eye as a target. Because the structure of the invention can be raised or lowered with the camouflage cover in place, even from remote locations, it eliminates the aiming point feature only minutes before an air attack, thus depriving enemy pilots the time needed to reorient for a bombing run. This feature also allows it to create confusion against smart munitions using preplanned flight paths and known backgrounds to guide them to their targets. This invention is applicable to military installations and to civilian or industrial backgrounds. Camouflage of the invention is installed in as little time as possible with a minimum of personnel. The equipment is easy to employ and transport and is not exceedingly bulky. It also allows for rapid modification of camouflage structures previously erected.

The traditional method of camouflaging using standard camouflage nets works most effectively with relatively small objects such as tanks or artillery pieces. Traditional methods may, of course, be used to camouflage an individual soldier. Visual effectiveness diminishes and logistical problems measured in terms of time, materiel and manpower associated with deployment, multiply when the goal is to camouflage a large, roofed building as opposed to relatively small objects with traditional camouflage nets. Large buildings which have a visible profile from the air would have to have nets cover the roof and the sides between the building and the ground. The logistical requirements (measured in time, materiel, and manpower) would make the application of this method of building camouflage impractical. Furthermore, the effectiveness of this method of building camouflage is limited. The nets alter the visible texture of the observed structure and reduce the contrast between an observed structure and its surroundings, however, the bulk and form of the building are usually still evident to an aerial observer. Nets, therefore, are not considered a feasible or practical approach to camouflaging large roofed buildings.

An alternative method of altering the appearance of roof expanses from the air, described in the literature, is to paint building shapes on the roof. Such painting is intended to depict light and shading in patterns similar to those made by surrounding buildings, as observed from the air, and generally to imitate the structures in adjacent areas. This technique is not very effective at fooling aerial observers because the painted shapes as seen from an oblique angle close up on one another. Additionally, because of a lack of texture and depth, painted shapes project a flat, dull appearance which is readily distinguishable from real structures.

The present invention relates to shape modification through three-dimensional structures which may be deployed or altered rapidly, and on short notice; in fact, as noted above, the structures may be raised and lowered repeatedly with the camouflage covers draped over the metal frame structure without the need to have personnel present to guide or assist the raising/lowering operations in any manner. The structures provide effective masking of edifices from aerial observation so that the potential target and its environs do not correspond to the expectations of an attacking pilot or aerial observer. The structure is characterized mainly in that it comprises a collapsible metal frame, fabric cover and means for raising and lowering the frame directly or from a remote location with the fabric cover in place over the frame structure. Windup cables with pulleys, spools, and a crank or winch are a manual scheme for operation, but any other suitable embodiment, including ones not specifically mentioned here, could also be incorporated into the overall design to assist with rapid deployment or lowering of a structure. An electric motor, activated from another or remote location by radio signal or other appropriate means, could be used to operate the raising and lowering mechanism. Similarly, gear motors or servos mounted on the roof of a building to be camouflaged and operable from ground or remote locations could be used to raise and lower a structure. The mechanical pulley and crank mechanism may be assembled to enable operation from a remote location by hand.

The particular means employed will be selected by one familiar with and skilled in the art from the resources at hand and in consideration of the particular needs and desires inherent in each circumstance.

The structures of the invention may be used in conjunction with paint and nets. For example, horizontal glass surfaces on rooftops such as skylights should be covered with nets if they are not located where they will be brought under the cover of a structure of the invention.

The structures of the invention may be deployed and raised intermittently as needed to confuse aerial observers, to preclude fixation of a pre-set target for programmed smart guided munitions, or (in conjunction with reflective or thermal materials) to present a false radar or infrared profile to airborne instrumentation. In a similar vein, the structures of the invention may be used by themselves to indicate troop structures and create decoy targets.

Other characteristics and objects of the invention are set out in the following description which, in conjunction with the attached drawings, shows a suitable embodiment of the invention.

SUMMARY OF THE INVENTION

This invention provides a three-dimensional shape modification camouflage structure for edifices having a large roof area. The camouflage structure is comprised of a light weight metal frame comprised of horizontal and vertical bar members which lie in substantially parallel arrays when the frame is assembled in its raised position and a fabric cover which is imbued with the colors and shapes of smaller edifices in the immediate vicinity of the larger edifice being camouflaged. The fabric cover is draped over the frame. The frame structure is capable of being raised and lowered in repeated and successive operations with the fabric cover draped over the frame in its appointed place. The structure in its manual embodiment also has at least two cable means which are used in the operations of raising and lowering the structure, usually from the ground or from some other remote location. It is desirable to supply each cable means with pulleys, both to guide the cable and to provide a mechanical advantage to winching in either the raising or lowering operations. Two hand cranks with take-up spools and a rod connecting the spools may be used for manually raising and lowering the structure. Weights may be distributed around the frame to bias the structure for easy lowering with the fabric cover in place. If a frame is to be placed upon the ground and against an exterior wall of the edifice to be camouflaged, then braces are to be installed on multiple vertical bar members to prevent the structure from traveling away from its appointed place. Rollers may be installed around the base of the frame to make it easier to roll the frame into its desired position. These structures may also be raised and lowered in repeated successive operations without the need for having personnel present to guide the structure and cover, or assist in any way, so that raising and lowering may also be accomplished even from remote locations, as indicated below, in relation to alternative embodiments.

In alternative embodiments, servo means such as motors or engines may be used in raising and lowering operations.

A method of camouflaging edifices having a large roof area is also disclosed. In this method, at least one camouflage structure of the invention is placed on the roof of the edifice to be camouflaged. In another embodiment, at least one camouflage structure is also placed on the ground and against one exterior wall of the edifice to be camouflaged, in addition to the one or more structure(s) placed on the roof of the edifice. In still another embodiment, painted lines are used in conjunction with the deployment of camouflage structures of the invention to camouflage an edifice against aerial observation.

DESCRIPTION OF THE PREFERRED EMBODIMENTS

The drawings show a collapsible frame covered with material capable of being raised and lowered repeatedly in successive operations without removing or reorienting the material on the frame and without the need for assistance by personnel at the site where the camouflage structure is placed, and a resultant camouflage structure that is placed on the roof or against a side wall of an edifice to provide shape modification camouflage. The frame is collapsible and may be rapidly raised and lowered as needed, without removing or reorienting or adjusting the fabric camouflage cover in any way. The frame may be raised and lowered with the aid of windup cables, pulleys, spools and cranks, as well as worm drive gearing, electrohydraulic mechanisms, gear motors, servos, etc. The structures may also be used in conjunction with a pattern of dark paint to augment the shape modification camouflaging effectiveness of the structures of the invention.

Shape modification of an edifice is accomplished by placing three-dimensional structures of the invention on the roof and if necessary along one or more side walls of the edifice. The structures have a frame comprised of aluminum or other suitable light metal material and are draped with a fabric-type material covering imbued with the shapes and colors of smaller structures, and details thereof such as windows and doors, in the immediate area of the edifice being masked. The roof structure of the invention will normally lie flat (be undeployed) until it is needed (i.e., a reconnaissance mission or an attack is expected). It may then be raised, even from a remote location (described more fully below), and subsequently lowered without removing or replacing the fabric cover over the frame in any way. More than one roof structure of the invention will be needed for larger edifices. The roof structures are intended to cast shadows in direct sunlight, as real buildings would, to break up an open roof expanse and provide the appearance of a texture different from the unaltered surface and to provide levels of depth that would not be apparent on the unaltered roof surface. Broad lines or stripes of dark paint, as described in relation to FIG. 1 below, can be used to heighten the perception of contrast between the different structures deployed on a rooftop. Building shape modification structures of the invention may also be deployed against the vertical walls of an edifice in substantially the same manner for the same ends as already set forth herein. These structures are also capable of being raised and lowered repeatedly and in successive operations with the fabric cover draped over the frame and without the need to remove or replace the fabric cover.

Figure 1:
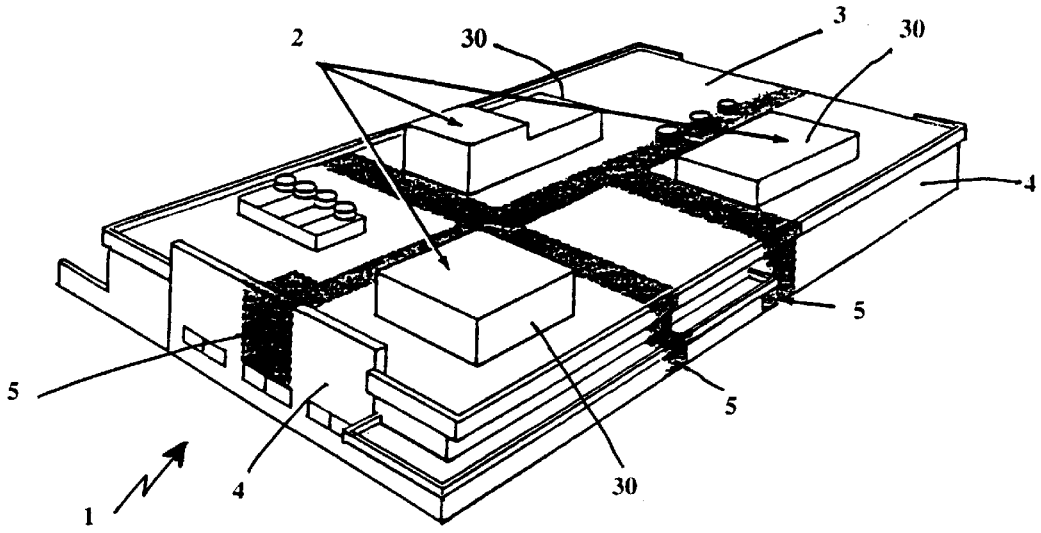
FIG. 1 shows shape modification structures of the invention deployed on the roof of a military or industrial edifice in conjunction with a pattern of dark paint lines.

The components and combinations of the invention will now be described in detail with reference to the four accompanying drawings. FIG. 1 shows a large roofed edifice 1 with three shape modification structures 2 of the invention placed on the roof 3 of the edifice. Camouflage material covering 30 is installed on the raised structures 2. A pattern of broad lines or stripes 5 in dark paint augments the camouflaging effectiveness of the structures 2.

Figure 2:
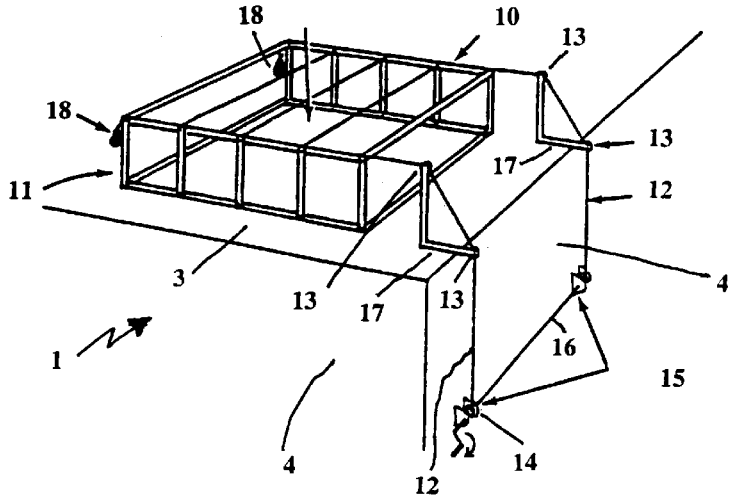
FIG. 2 shows a structure's frame in its raised (deployed) position with the manual components used to raise or lower the frame in deployment (raising) or lowering operations.

FIG. 2 shows the metal frame 10 for the building shape modification structure and the cable apparatus which may be used to assist in the raising and lowering of the frame 10. The frame 10, as shown, is assembled as a parallel bar linkage which, preferably, will be raised and lowered in its manual embodiment with the aid of cranks, cables and pulleys which allow operation from ground locations (described in greater detail below). (Other windup and lowering mechanisms could be used such as electric gear motors, electric motors with chains/sprockets or worm gear drives, gear motors, servos, etc. Any of these would also allow for operation from remote locations. Alternative acceptable means are given by example in more detail, below.) The cable apparatus comprises windup cable 12 attached to the frame 10 as shown in the figure, a crank 14 for paying out or taking up cable 12, windup spools 15 for collecting the cable, a rod 16 attached at either end to the windup spools 15 to ensure that they turn in unison, "L" structures 17 for mounting pulleys 13, hinges or pivots 11 at the base of the frame 10 to allow for raising and lowering of the frame, and weights 18 may optionally be employed to bias the structure to lower easily with the material cover 30 (not shown in FIG. 2; shown in FIGS. 5 and 6) in place. The cable apparatus and the weights are optional features of the invention; they are part of the invention in its manual embodiment.

Figure 3:
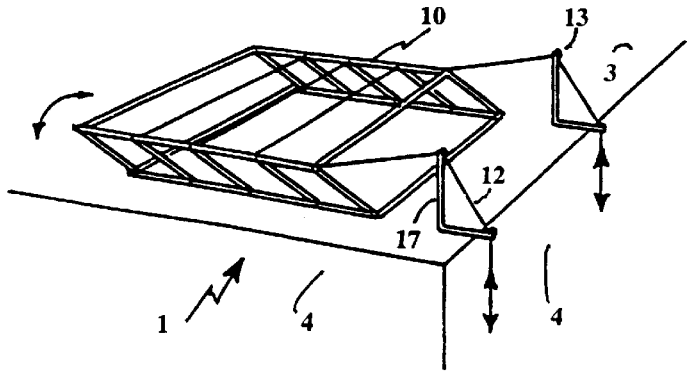
FIG. 3 shows the frame in raising/lowering position (mediate position between fully raised and fully lowered).
Figure 5:
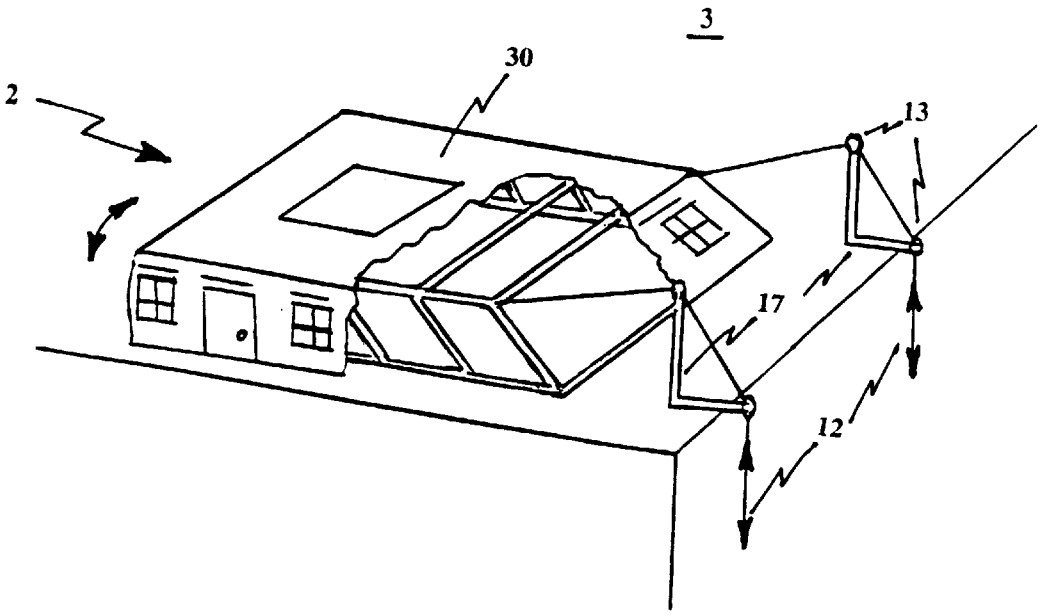
FIG. 5 shows a structure of the invention with a camouflage cover placed thereon in partial cutaway view in a position mediate between being fully raised and fully lowered.
Figure 6:
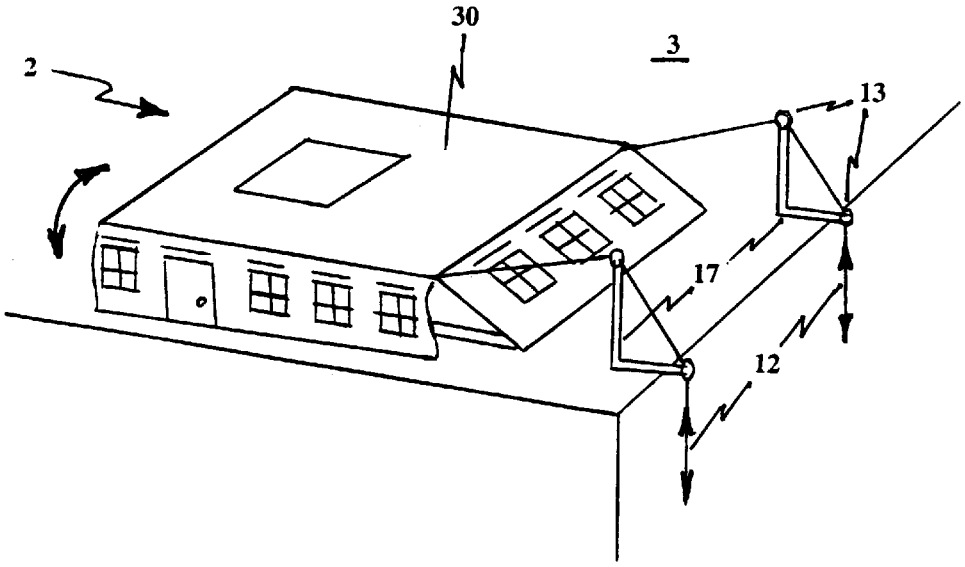
FIG. 6 shows a structure of the invention with a camouflage cover placed thereon in a position mediate between fully raised and fully lowered, from the same perspective as that shown in FIG. 5.

FIG. 3 shows a frame 10 in a mediate position between fully raised and fully lowered, to illustrate the manner in which the parallel bar arrangement of the frame members may be assembled to work in the manner called for herein. There are hinge members 11 at each juncture where vertical members of the frame 10 are joined to horizontal base members. FIGS. 5 and 6 also show a frame 10 in a mediate position between fully raised and fully lowered to illustrate the manner in which the assembly may be raised and lowered with the fabric cover 30 in place.

Figure 4:
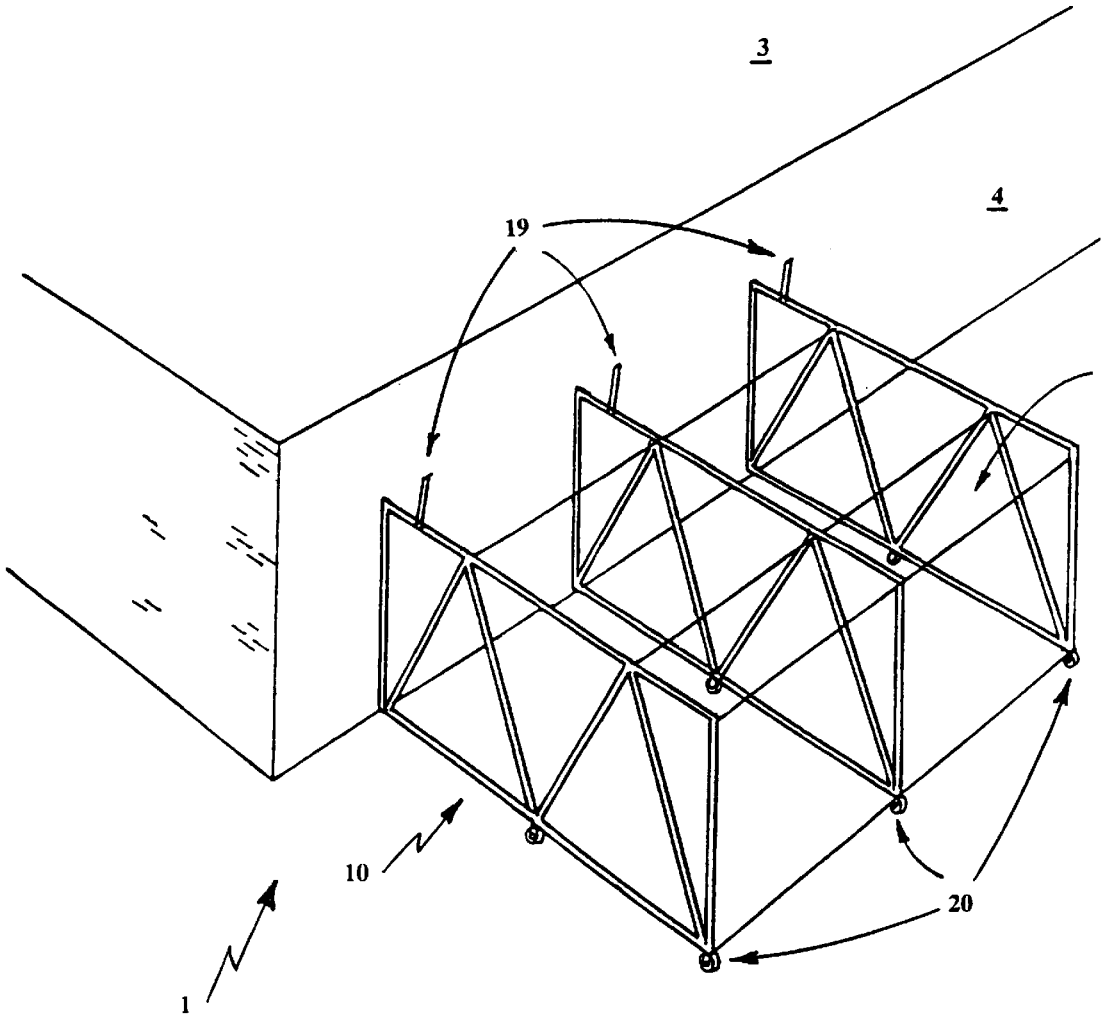
FIG. 4 shows a structure of the invention used in side wall shape modification.

The frame 10 adapted for building shape modification camouflage against a side wall 4 of an edifice 1 at ground level is shown in FIG. 4. In this adaptation, the structure may be equipped with rollers 20 to make the structure easier to deploy, and braces 19 which hold the vertical members of the frame 10 portion of the structure in substantially perpendicular alignment with the ground and the horizontal members of the frame 10 in substantially perpendicular alignment with the face of the side wall 4, all as shown in the figure.

As noted above, the parallel bar linkage assembly comprising the frame of the camouflage structure may be raised and lowered manually, with the pulley/cable/crank assembly described above, or by a powered drive system, either way with the fabric cover 30 remaining in place. A gear motor or electrical hydraulic pump would provide suitable drive systems. The drive system would be directly connected to the parallel bar linkage frame by cables; linking the drive motor to the pulley and crank assembly of the manual system would accomplish this connection in an acceptable manner. The drive system can also be connected directly to the parallel bar linkage without cables or pulleys, e.g., a worm gear drive could raise and lower the mechanism. Control of the drive system could be by hard wiring, with the drive system operated from the ground or a nearby location. Alternatively, the drive system could be radio controlled from a remote location. In the hard wired operating mode, a relay controlled by an up-down switch would start the motor for raising the parallel bar structure. A limit switch would stop the drive system when the frame had been raised to a given point. Activating the relay by means of the up-down switch would allow lowering by reversing the electric motor. A lowering limit switch would stop the drive system when the structure had been sufficiently lowered. The remotely controlled mode would operate in a similar fashion except that a transmitter and receiver would be used. Transmission of a signal would activate a relay which would start the drive system for raising the structure. Again, a limit switch would stop the drive system once the structure had been raised to a given point. Transmission of a lowering signal would start the process in reverse until a lowering limit switch is tripped.

In designing and deploying the structures of the invention, the structural integrity of the edifice's roof and wind forces should be considered. Horizontal glass surfaces such as skylights should be covered in some manner, either by placing structures of the invention over them or draping them with camouflage netting or similar textured material which allows some passage of light. Vertical glass surfaces are not detectable from the air and therefore need not be masked.

Other and further embodiments and adaptations beyond those described in detail here will no doubt occur to others who are skilled practitioners of the art to which this invention pertains. Unless omitted from the scope of the claims which follow, any such derivative embodiments or adaptations are deemed to lie within the scope of the present invention.

What is claimed is:

1. A three-dimensional shape modification camouflage structure for camouflaging large, roofed edifices from aerial observation comprising:

a metal frame comprised of metal bar members in substantially parallel horizontal and substantially parallel vertical arrays when assembled, having hinge means connecting the bars at substantially perpendicular junctions when assembled, which allow for the frame to be raised or lowered;

a fabric cover imbued on its outside surface with shapes and colors resembling detailed attributes of surrounding smaller edifices for placement over the frame to form a three-dimensional camouflage structure;

at least two crank means;

at least two windup cable means, each attached at one end to the upper portion of the frame and at the other to a crank means;

pulley means for each cable means for guiding the cable means and for providing mechanical advantage to the crank means; and supporting structure for the pulley means, wherein the frame is capable of being raised and lowered repeatedly and successively with the fabric cover placed over the frame.

2. The camouflage structure of claim 1 further comprising weight means to bias the structure to lower easily to the undeployed position with the fabric cover in place.

3. The camouflage structure of claim 1 further comprising bracing means for structures deployed against the side wall of the edifice to hold the vertical bar members of the structure in place in the deployed position against the side wall of the edifice being camouflaged, thus preventing the structure from traveling away from its appointed place.

4. The camouflage structure of claim 1 further comprising servo means for operating the crank means to move the structure between its deployed and undeployed positions.

5. A three-dimensional shape modification camouflage structure for camouflaging large, roofed edifices from aerial observation comprising:

a metal frame comprised of metal bar members in substantially parallel horizontal and substantially parallel vertical arrays when assembled, having hinge means connecting the bars at substantially perpendicular junctions when assembled, which allow for the frame to be raised or lowered;

a fabric cover imbued on its outside surface with shapes and colors resembling detailed attributes of surrounding smaller edifices for placement over the frame to form a three-dimensional camouflage structure;

powered drive means capable of raising and lowering the metal frame, connected directly to said frame, wherein said frame is capable of being raised and lowered with the fabric cover placed over the frame.

6. The camouflage structure of claim 5 further comprising weight means to bias the structure to lower easily to the undeployed position with the fabric cover in place.

7. The camouflage structure of claim 5 further comprising bracing means for structures deployed against the side wall of the edifice to hold the vertical bar members of the structure in place in the deployed position against the side wall of the edifice being camouflaged, thus preventing the structure from traveling away from its appointed place.

* * * * *